US011066821B2

(12) United States Patent
Aldridge

(10) Patent No.: US 11,066,821 B2
(45) Date of Patent: Jul. 20, 2021

(54) TOILET BOWL CHEMICAL AGENT DISPENSER

(71) Applicant: Warren Aldridge, Huntsville, AL (US)

(72) Inventor: Warren Aldridge, Huntsville, AL (US)

( * ) Notice: Subject to any disclaimer, the term of this patent is extended or adjusted under 35 U.S.C. 154(b) by 0 days.

(21) Appl. No.: 16/423,001

(22) Filed: May 25, 2019

(65) Prior Publication Data

US 2019/0360187 A1 Nov. 28, 2019

Related U.S. Application Data

(60) Provisional application No. 62/676,346, filed on May 25, 2018.

(51) Int. Cl.
*E03D 9/02* (2006.01)

(52) U.S. Cl.
CPC ..... *E03D 9/02* (2013.01); *E03D 2009/024* (2013.01)

(58) Field of Classification Search
CPC ..... E03D 9/032; E03D 9/022; E03D 9/03; E03D 9/033; E03D 9/038; E03D 9/02; E03D 2009/024; E03D 2009/026; E03D 2009/028
USPC ..... 4/225.1
See application file for complete search history.

(56) References Cited

U.S. PATENT DOCUMENTS

| | | | | |
|---|---|---|---|---|
| 1,621,737 | A * | 3/1927 | Moore | E03D 9/04 4/225.1 |
| 3,945,062 | A * | 3/1976 | Corsette | E03D 9/037 4/225.1 |
| 4,467,480 | A | 8/1984 | Keller | |
| 4,760,612 | A | 8/1988 | Dufau | |
| 5,387,249 | A | 2/1995 | Wiecorek | |
| 5,778,459 | A | 7/1998 | Guerin | |
| 5,918,320 | A * | 7/1999 | Reals | E03D 9/02 4/222 |
| 5,924,142 | A | 7/1999 | Wang | |
| 5,987,655 | A | 11/1999 | Smet | |
| 6,321,392 | B1 | 11/2001 | Sim | |
| 8,112,824 | B2 | 2/2012 | Spogardh | |
| 9,175,462 | B2 | 11/2015 | Berry | |
| 2006/0242754 | A1* | 11/2006 | Coppock | E03D 9/037 4/224 |
| 2017/0211266 | A1* | 7/2017 | Galligar | E03D 9/031 |

FOREIGN PATENT DOCUMENTS

| | | | |
|---|---|---|---|
| WO | 2007107769 | A1 | 9/2007 |
| WO | 2010139584 | A1 | 12/2010 |

* cited by examiner

*Primary Examiner* — Erin Deery
(74) *Attorney, Agent, or Firm* — Patent Grove LLC; Tomas Friend

(57) ABSTRACT

A device for delivering a chemical additive from a location at the top of an overflow tube to a toilet bowl has an upper portion that does not fit into the overflow tube and a lower portion that fits inside the overflow tube. The upper portion has a receptacle that can hold a chemical additive so that water flowing into the overflow tube runs over the additive and into the overflow tube.

8 Claims, 2 Drawing Sheets

TOILET BOWL CHEMICAL AGENT DISPENSER

BACKGROUND OF THE INVENTION

Field of Invention

The invention relates to devices and systems used for dispensing a chemical agent into an overflow tube of a toilet.

Description of Related Art

A common occurrence in most bowl type toilets is the formation of unsightly rings and other discolorations which are the visible exhibition of the development of fungi, bacteria and/or mold. These formations may appear at the water line as well as on the bowl surface which is beneath the water line and in other crevices and cavities of the toilet bowl.

A traditional method for removal of these formations and to restore the bowl to a visibly clean state has involved the manual and undesirable effort of scrubbing the bowl with any of a variety of available cleaning and sanitizing products. Subsequent to cleaning, it is common for one or more chemical agents to be placed in the toilet tank, or cistern, that release chemical agents into the bowl during the flush cycle. The chemical agents are dispersed in the holding tank water prior to the flush cycle through the immersion and subsequent dissolving of a chemical tablet or other solid form, such that the holding tank water continually dissolves the tablet. The chemical agents are then moved from the tank to the toilet bowl upon the flush cycle. Many such products also utilize a colorant to show their presence in the toilet bowl. The release of standing water from the toilet holding tank during a flush cycle, however, results in most of the released chemical agent being flushed through the toilet bowl and into the sewer/septic drain pipe rather than remaining in the toilet bowl.

One commonly used alternative bowl cleaning and sanitizing system involves the use of a clip-on device attached to the toilet bowl rim which contains one or more chemical agents. When the toilet is flushed, water from the holding tank flows or cascades across the device to dissolve the chemical agent(s) and release them into the toilet bowl. As with the chemical agents placed in the holding tank, however, much of the agent(s), however, travels through the bowl and into the drain.

The placement of chemical agents for delivery through the toilet overflow tube represent another alternative to chemical agents placed in the tank or bowl. For example, U.S. Pat. Nos. 3,945,062, 4,760,612, 5,152,015, 5,387,249, 5,778,459, 5,924,142, 6,321,392, 9,175,462, US 2018/0044902, and WO 2010/139584 describe devices for delivering solutions of cleaning liquids into an overflow tube of a toilet. An advantage of delivering a solution of cleaning and/or sanitizing agents through the overflow tube is that, during the final phase of the flush cycle, the toilet bowl is refilled via the overflow tube, typically via a refill hose that delivers water into the upper end of the overflow tube. As a consequence, cleaner/sanitizer delivered through the overflow tube during the final phase of the flush cycle does not travel beyond the bowl and into the drain. One disadvantage associated with these liquid delivery systems is that a portion of the tank space below the full waterline is occupied by one or more components of the system. This reduces the volume of water available for each flush which, in turn, reduces the effectiveness of the flush cycle, leaving waste in the bowl after the cycle and/or eventually leading to a buildup of waste and clogs in sewer or septic pipes. Some systems do not allow all of the normal refill water volume from entering the toilet bowl and thereby affect the performance of the toilet function. Another disadvantage is that these systems are often cumbersome to use and the cost of manufacturing results in an unacceptable price point for consumers. Complex systems are also more prone to failure than simple systems.

U.S. Pat. No. 4,467,480 describes a water conditioning device for a toilet that includes a a receptacle that is suspended in the overflow pipe below the discharging end of the refill hose or pipe. The receptacle contains a conditioning chemical and captures only a portion of the water discharged from the into the overflow pipe, with the rest of the water passing down around the receptacle. The captured water is placed in contact with the chemical to form a solution, which trickles out of the receptacle and down through the overflow pipe and into the toilet bowl. Straps allow the receptacle to be positioned well inside the overflow tube.

U.S. Pat. No. 5,987,655 describes a flush tank water conditioning device containing a solid chemical compound column that is suspended in the overflow tube of a toilet reservoir tank. The column dries between flushes to conserve conditioning chemicals and to prevent excessively high concentrations of conditioning chemicals from being delivered into the bowl. The water conditioning device comprises an insoluble support frame that extends downward into the overflow tube and comprises a mixture or compound of one or more water soluble water conditioning agents.

A drawback to the aforementioned devices is that the receptacle may block the normal flow water through the overflow tube or pipe because it reduces the cross-sectional area of the tube. If a piece of the solid were to break off, the piece may block or impede the flow of water through the overflow tube or possibly prevent the overflow tube from serving its intended purpose of preventing overflow in the tank. Another drawback is that he entire device is replaced when the chemical contents are depleted, rather than simply replacing the chemical component.

WO 2007/107769 describes a lavatory dispensing device having a hanger that is suspended in the interior the overflow tube of a toilet. A compressed solid block composition comprising at least one chemical agent forms a treatment composition when the compressed block is contacted with water supplied to the interior of the overflow tube. The hanger may be removed and refilled with solid block composition but the placement of the device in the interior of the overflow tube has the same drawbacks related to interference with the flow of water through the overflow tube as the aforementioned devices.

A need remains for a device for providing chemical agent(s) to the toilet bowl during the refill process that overcome and/or mitigate the drawbacks of existing devices and methods.

SUMMARY OF THE INVENTION

Embodiments of the present invention preferably seek to mitigate, alleviate or eliminate one or more deficiencies, drawbacks or issues in the art, such as the above-identified, singly or in any combination by providing a device and a system according to the appended patent claims. The present invention provides for the treatment of water being delivered to the bowl of a toilet through the overflow tube without using holding tank water as the dispersion means and without subjecting the toilet holding tank water to unnecessary exposure to any chemical agents that can ultimately damage the toilet flapper and other components. Embodiments of the device and system do not interfere or change the flush cycle by diminishing the available water to refill the bowl or inhibit the safety features of the overflow tube. This device and system are suitable for use with various toilet designs, toilet brands, and toilet sizes, without need for modifications or adjustments to toilet mechanisms.

In one aspect, the invention provides a device configured to rest securely at the top of the overflow tube of a toilet without the use of mechanical attaching hardware and to hold a chemical solid comprising a water soluble cleaning and/or sanitizing composition in the path of water entering into the top of the overflow tube.

In another aspect, the invention provides a device configured to have a shape that cannot interfere with the overflow function of the overflow tube whether a chemical solid is present placed int the device.

In yet another aspect, the invention provides a system comprising a device configured to rest securely at the top of the overflow tube of a toilet and a chemical solid comprising a cleaning and/or sanitizing composition configured to be placed in the device.

These and other advantages and aspects of the invention are described in more detail herein below.

BRIEF DESCRIPTION OF DRAWINGS

These and other aspects, features and advantages of which embodiments of the invention are capable of will be apparent and elucidated from the following description of embodiments of the present invention, reference being made to the accompanying drawings, in which.

DETAILED DESCRIPTION OF THE INVENTION

As used herein, "a solid" is meant to include include crystalline and amorphous solids, as well as gels and pastes having viscosities hight enough for them to maintain their shape when placed into a receptacle.

"Soluble" in reference to solid chemical additives refers to solubility in water at rom temperature to form an aqueous solution. Chemical additives and solids may comprise small particles that are not soluble in water or that have a solubility in water at room temperate insufficient to form a solution. Such particles may be released from a solid chemical additive composition when soluble material dissolves.

A solid chemical additive composition may be in the form of a single, solid piece in the shape of a tablet, capsule, ball, cube, stick, pyramid, tetrahedron, for example. The solid may comprise multiple solid pieces such as beads or grains. A solid may be contained in a water soluble capsule or in a water soluble or insoluble bag or net.

Figure 1:
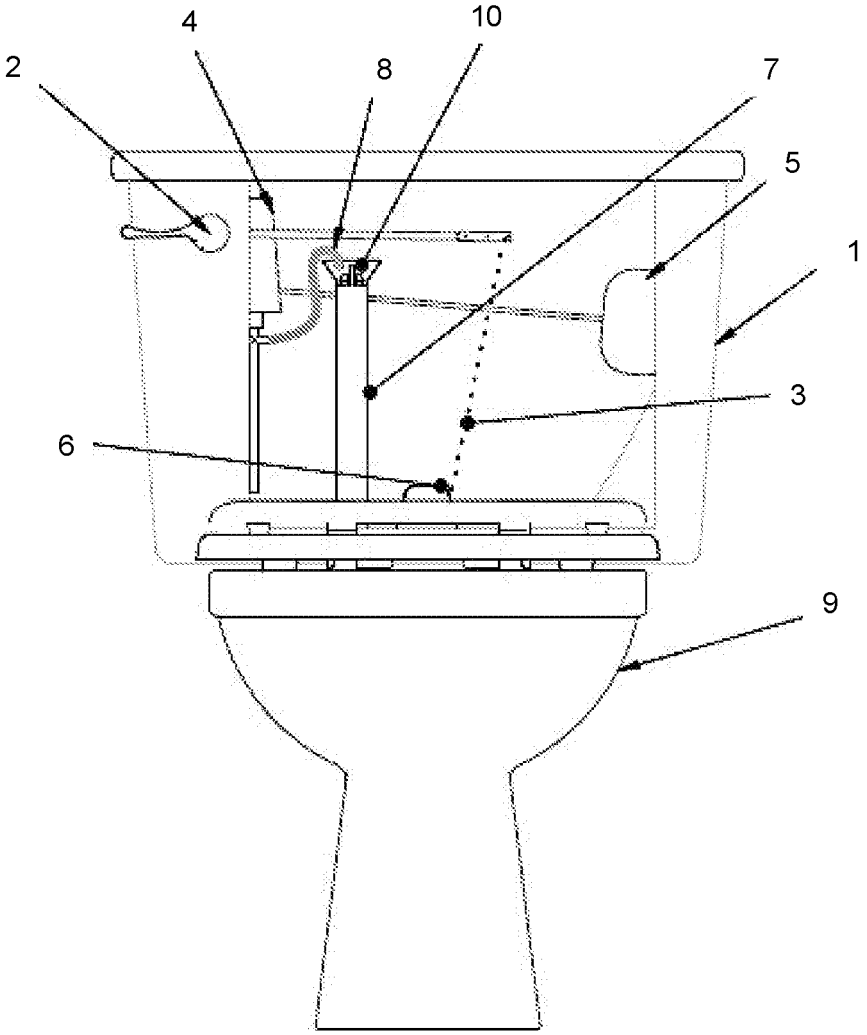
FIG. 1 is an illustration of a device according to the invention in a conventional toilet and FIGS. 2*a-c* are illustrations of different embodiments of a device according to the invention.

FIG. 1 shows a toilet with standard components and a device (10) according to the invention in place in place in the toilet. The toilet comprises a holding tank (1), flush handle (2), chain (3), refill valve (4), float assembly (5), flapper valve (6), overflow tube (7), refill hose (8), and toilet bowl (9). Alternative arrangements of parts are also available, for example with one or more flush buttons positioned in the lid of the tank rather than on the front and the use of a rod in place of a chain.

To initiate the flush cycle, the flush handle (2) is actuated which, through a mechanical connection, lifts and unseats the flapper valve (6). This unseating breaks the seal and allows water from the holding tank (1) to rush into the toilet bowl (9) to create the commonly observed flush action of the toilet and evacuates the contents of the toilet bowl (9) to a sewer or septic system. As the water level in the holding tank (1) lowers, the tank level float assembly (5) drops, causing the refill valve (4) to open and begin the tank refill process. The flapper valve (6) reseats, creating a seal so that the holding tank (1) retains the incoming water. During the refill process, incoming water is diverted into two different streams, with the holding tank (1) receiving the majority of the flow and refill hose (8), which delivers water into the overflow tube (7). The water entering the overflow tube (7) flows directly into the toilet bowl (9). The refill valve (4) continues to provide water to the tank and separately to the toilet bowl (9) until the water level in the holding tank (1) lifts the float assembly high enough to close the refill valve (4). When the refill valve is closed, the flow of refill water is stopped to both the holding tank (1) and the toilet bowl (9), and the water level in the holding tank (1) and the toilet bowl (9) should be at their proper levels.

The inventive device (10) is designed to be placed at the top of the overflow tube (7) and not to interfere with the function of the overflow tube (7) or the proper levels of water in the tank (1) or bowl (9). The shape and design of the device (10) allow all of the refill water to flow into the toilet bowl as if the device were not present. Placement of the device or system comprising the device does not encumber or significantly alter the original function of the overflow tube as intended by the toilet manufacturer. In the case of a faulty shutoff valve, the holding tank continues to fill but is spared from overflowing due to the overflow feature of the overflow tube.

Figure 2A:
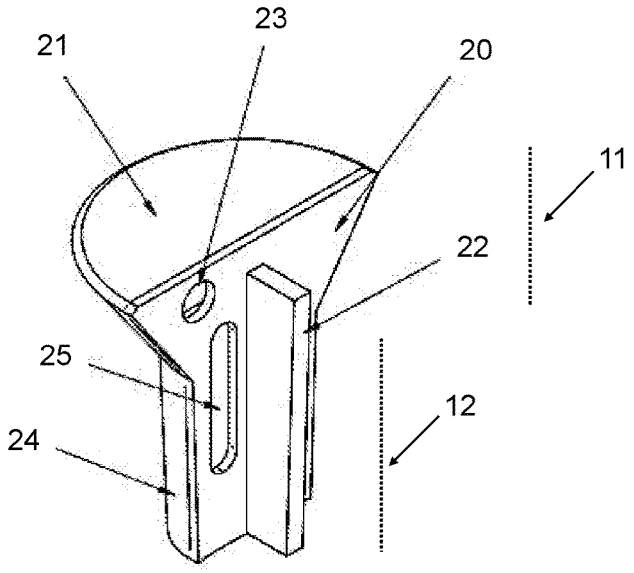
Figure 2B:
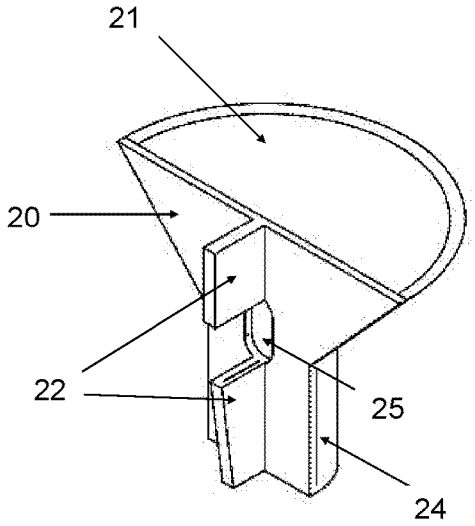
Figure 2C:
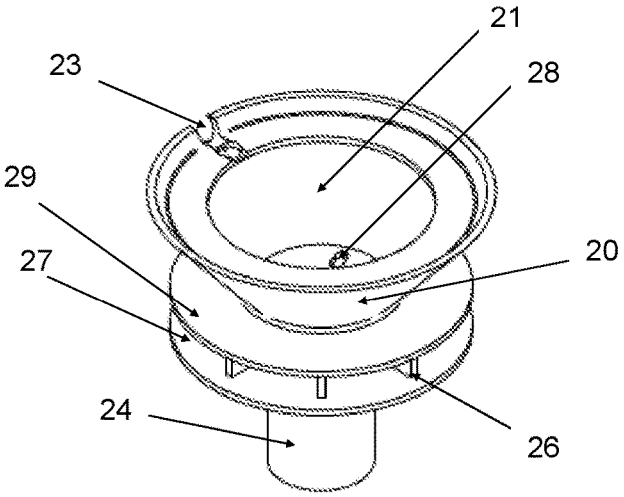

FIGS. 2*a*-2*c* show different embodiments of a chemical delivery device (10). The device comprises an upper portion (11) and a lower portion (12) (FIG. 2*a*). The upper portion comprises a receptacle (21) having a wall (20). The receptacle is meant to contain a solid chemical additive to be delivered into the bowl of the toilet. The chemical additive composition is placed into the receptacle (21), which comprises one or more delivery openings (28) that allow dissolved chemical additive to pass into the lower portion of the device (12). The delivery opening(s) may be in the from of one or more holes in the wall (20) of the receptacle (21) and/or an opening in the wall (20) of the receptacle (21) covered by a mesh or netting. This allows the solid chemical composition to remain in the receptacle (21) as repeated contact with water flowing from the refill hose (8) into the receptacle dissolves portions of the solid, reducing its size. The wall (20) of the receptacle (21) may comprise a hose retaining opening (23) to retain the refill hose (8) in a position so that, during the fill phase of the flush cycle, water passes over solid chemical agent in the receptacle (21). When flow of refill water ceases, the chemical agent ceases to be dissolved or eroded. This allows a greater life cycle for the chemical agent as it is only diminishes in quantity during the refill phase of each flush cycle.

The lower portion (12) of the device (10) is sized to fit into the upper end of the overflow tube (7) and comprises a passage (24) that receives dissolved chemical agent from the receptacle (21) and allows the liquid to pass through the passage and down the overflow tube (7) and into the bowl (9). One or more support tabs (22) may extend radially from the wall (20) of the lower portion (12) and optionally from the upper portion (11). The support tab (22) extending from the lower portion (12) helps hold the lower portion in place within the top end of the overflow tube (7). A support tab extending from the upper portion (11) may be useful for an embodiment the device (10) that is sized so that a part of the upper portion extends into the overflow tube (7). The diameter of a typical overflow tube (7) may be approximately 1 to 1.5 inches.

The receptacle (21) shown in FIGS. 2*a* and 2*b* has a half funnel, or semi-conical, shape with a taper from the top to the bottom. In these embodiments, the bottom end of the upper portion (11) meets the top end of the lower portion (12). The device (10) may have a unitary construction made, for example, of injection molded plastic or 3-D printing. Alternatively, the device (10) may be made of separate parts that are snapped, glued, an or screwed together or otherwise assembled. An advantage of the geometry shown in FIGS. 2*a* and 2*b* is that approximately half of the cross sectional area of the overflow tube (7) is occupied by the device (10), including the lower portion (12). As a result, even if the passage (24) were to become completely blocked, the overflow tube would continue to function to drain water from the tank into the bowl if the tank were being continuously filled between flushes. In preferred embodiments, around half of the cross-sectional area of the overflow tube (7) is occupied by the device (10). Approximately half may be a range of from 40% to 60% or from 45% to 55%.

Depending on the form and composition of a solid chemical additive placed into the receptacle (21), it may be possible for one or more delivery openings (28) to become partially or completely blocked as the solid dissolves, becomes smaller, and moves to the bottom of the receptacle. If the flow rate of water moving through the refill hose (8) is too high, all of the water may not be able to flow through the receptacle (21). The device (10) may include one or more bypass portals (25) designed to allow liquid, including water and dissolved solids, to flow from the receptacle (21) and into the overflow tube (7) by a path separate from the delivery opening(s) (28). In FIG. 2*a*, the bypass portal (25) comprises an opening in the wall of the receptacle (21) and passage (24). In FIG. 2*b*, the bypass portal (25) comprises an opening in the wall of the receptacle (21) at the bottom of the upper portion (11).

An advantage of the D-shaped receptacle (21) allows for an irregular decomposition and dissolution of a single solid chemical agent to maintain an uneven shape to the solid, which lowers the potential for blockage of the semi-conical tapered receptacle (21).

FIG. 2*c* shows an embodiment of the device (10) having an upper portion 11 with a full conical shape and a cylindrical passage (24) having an outer diameter allowing it to fit inside the overflow pipe (7). In this embodiment, the lower portion 12, including the passage (24) occupies nearly all of the top end of the overflow pipe. The device (10) comprises a first flange (27) extending radially from the device above the passage in the lower portion. The first flange has a diameter greater than that of the overflow tube (7) to hold the upper portion (11) of the device above the top end of the overflow tube. The device (10) comprises a second flange (29) parallel to and above the first flange (27). The first and second flanges (27,29) may be separated by supporting struts (26) that maintain a gap distance between the two flanges. In this embodiment, openings in the wall (20) of the device between the struts (26) and between the flanges (27,29) form channels through which water can pass from the tank (1) and into the passage (24). This bypass between the first and second flanges ensures that a flow of water from the tank and into the overflow tube is available in case the tank over fills.

The drawings provide non-limiting examples of tapers and geometric shapes for the device (10) and upper (11) and lower (12) portions. Other tapers, such as stepped, discontinuous, and variable taper angles are also possible, as are different cross-sectional shapes for the receptacle (21) and passage (24). The present disclosure is not intended to be limited to the preferred, exemplary, or primary embodiment(s) described herein. The foregoing description of preferred embodiments is presented for purposes of illustration and description and is not intended to be exhaustive or to limit the present disclosure to the precise forms disclosed. The embodiments are chosen and described to provide the best illustration of the principles of the present disclosure and its practical application to thereby enable one of ordinary skill in the art to utilize the present disclosure in various embodiments and with various modifications.

The invention claimed is:

1. A device for delivery of a chemical agent into a toilet bowl from a top portion of an overflow tube during a refill phase of a flush cycle of a toilet, said device comprising:

an upper portion comprising a receptacle configured to receive and retain a solid chemical agent;

a lower portion configured to fit into a top portion of the overflow tube and comprising a passage configured to receive liquid from the receptacle and direct the liquid into the overflow tube; and a bypass opening in a wall of the receptacle, said bypass opening positioned such that liquid entering the receptacle can flow into the overflow tube without passing through the passage when the passage is blocked; and wherein the upper portion comprises a taper so that a top end of the upper portion is wider than a bottom end of the upper portion and the upper end of the upper portion is configured to be wider than a diameter of the overflow tube.

2. The device of claim 1, wherein said bypass opening is in the wall of the receptacle and in a wall of the passage.

3. The device of claim 1, wherein the lower portion and passage are dimensioned to occupy approximately half of a cross sectional area of the overflow tube or less.

4. The device of claim 1, wherein a wall of the upper portion comprises an opening sized to retain a portion of a refill hose.

5. The device of claim 1, further comprising a support tab extending radially from a wall of the lower portion, said tab configured to hold the lower portion in place when the lower portion of the device is placed in the top portion of the overflow tube.

6. The device of claim 5, further comprising a support tab extending radially from the top portion.

7. The device of claim 1, wherein the receptacle has a half funnel or semi-conical shape.

8. A system for delivery of a chemical additive into a toilet bowl, said system comprising the device of claim 1 and a solid chemical additive in solid form sized to be retained in the receptacle.

* * * * *